US008003199B2

(12) United States Patent
Schoela et al.

(10) Patent No.: US 8,003,199 B2
(45) Date of Patent: Aug. 23, 2011

(54) NOISE PREVENTION PLATE CONSISTING OF ACRYLIC GLASS

(75) Inventors: Egbert Schoela, Baden (AT); Gerald Molnar, Gramatsneusiedl (AT); Gerd Hampl, Bruck/Leitha (AT); Peter Seelmann, Vienna (AT); Mojmir Ruzicka, Vienna (AT)

(73) Assignee: EVONIK ROHM GmbH, Darmstadt (DE)

( * ) Notice: Subject to any disclaimer, the term of this patent is extended or adjusted under 35 U.S.C. 154(b) by 1682 days.

(21) Appl. No.: 10/510,963

(22) PCT Filed: Jun. 30, 2003

(86) PCT No.: PCT/EP03/06939

§ 371 (c)(1),
(2), (4) Date: Nov. 1, 2004

(87) PCT Pub. No.: WO2004/018196

PCT Pub. Date: Mar. 4, 2004

(65) Prior Publication Data

US 2005/0211946 A1 Sep. 29, 2005

(30) Foreign Application Priority Data

Aug. 20, 2002 (DE) ..... 102 38 992

(51) Int. Cl.
*B32B 7/02* (2006.01)

(52) U.S. Cl. ..... 428/212; 428/297.4; 428/379; 181/210; 181/285; 52/144; 252/62

(58) Field of Classification Search ..... 428/300.1, 428/301.4, 212, 297.4, 378, 379; 442/44, 442/19; 181/210, 285; 52/144; 252/62
See application file for complete search history.

(56) References Cited

U.S. PATENT DOCUMENTS

| | | | | |
|---|---|---|---|---|
| 3,780,156 | A | 12/1973 | Cameron | |
| 4,904,760 | A * | 2/1990 | Gaku et al. | 528/422 |
| 5,040,352 | A * | 8/1991 | Oberlander et al. | 52/786.11 |
| 5,372,866 | A * | 12/1994 | Oberlander et al. | 428/110 |
| 5,916,676 | A * | 6/1999 | Stasi | 428/364 |
| 5,985,972 | A | 11/1999 | Minghetti | |
| 6,305,492 | B1 | 10/2001 | Brand et al. | |
| 6,726,970 | B2 * | 4/2004 | Schoela et al. | 428/35.7 |
| 2003/0008126 | A1 * | 1/2003 | Boesman et al. | 428/300.7 |
| 2003/0017289 | A1 * | 1/2003 | Schoela et al. | 428/35.7 |

FOREIGN PATENT DOCUMENTS

| | | |
|---|---|---|
| EP | 0 078 640 | 5/1983 |
| EP | 0 516 299 | 12/1992 |
| WO | WO 01/56784 A1 * | 8/2001 |

OTHER PUBLICATIONS

Clercq, Elsie; A Reinforcing Structure for Stiff Composite Articles; Dec. 13, 2000, WIPO, WO 01/43952.*

Alexandria Online Dictionaries (2003), at http://www.sensagent.com/dictionaries/en-en/adhesion.*

* cited by examiner

*Primary Examiner* — Mark Ruthkosky
*Assistant Examiner* — David J Joy
(74) *Attorney, Agent, or Firm* — Oblon, Spivak, McClelland, Maier & Neustadt, L.L.P.

(57) ABSTRACT

An acrylic glass plate for use as an opaque noise protection element in noise protection walls, the plate measuring a minimum of 2×2 m and having a minimum thickness of 8 mm wherein threads, strips, grids or networks consisting of a material which is incompatible with the acrylic glass are integrated into the acrylic glass for binding splinters in the event of a fracture of the plate, and the plate comprises between 40 and 80 wt. % of filling materials, in relation to its total weight (calculated without integrated threads, strips, grids or networks); and a method for producing such plates.

21 Claims, No Drawings

NOISE PREVENTION PLATE CONSISTING OF ACRYLIC GLASS

The present invention relates to acrylic sheets, and also to their use as a sound-deadening sheet, in particular as a unit in noise barriers.

For many years, noise-prevention embankments, noise barriers or sound-deadening facades have been used to protect citizens from traffic noise. Embankments require much space and are therefore preferably raised on open ground, whereas noise barriers or sound-deadening facades are used in inner-city areas, with bridge structures, and often also along sections of railroad.

Materials which have become established in industry in recent years for space-saving noise barriers include wood, metal and concrete in the non-transparent sector, and also conventional glass materials and plastics in the transparent sector.

Transparent noise barriers made from plastics materials are manufactured in particular from polymethyl methacrylate (PMMA) or from PMMA-based moulding compositions, since this material not only has excellent transparency and exceptional optical properties but also provides superb sound-deadening together with good physicomechanical properties (stone impact resistance).

The relatively high price of transparent noise barriers is certainly a disadvantage, transparent units consequently being in general use only where it is important that, despite their height, the barriers do not completely separate the automobile driver or the passenger in a rail vehicle from the environment. This factor is significant, for example, in avoiding any possible "tunnel effect" on bridges, but even here the practice is now to make only parts of these barriers transparent, not least because of the high price.

There is therefore a considerable requirement for low-cost space-saving units which nevertheless have the excellent sound-deadening properties and useful mechanical properties of acrylic sheet. The cost of the units should, as far as possible, be markedly lower than that of the known acrylic sheets. In addition, industry has long demanded units which are non-transparent units but can easily be combined with transparent sound-deadening acrylic sheets, in particular capable of being used with the same method of installation and fixing.

An additional factor is that the known transparent plastics sound-deadening sheets are generally composed of acrylic sheet with dimensions of about 2×2 m, which in the case of relatively large noise barriers gives a corresponding separation of posts between one unit of the barrier and the next. Stronger sheets would have to be used if the separation between posts were to be increased, e.g. to 3×2 m or 4×2 m. Nevertheless, wind load calculations show that for certain extreme wind loads even the use of acrylic sheet with thicknesses of 25, 30 or 35 mm is insufficient to meet the requirements, quite apart from the high price of acrylic sheets of these thicknesses.

It would therefore also be desirable to make a further improvement in the mechanical properties, for example the modulus of elasticity, of the novel sound-deadening sheets when compared with known acrylic sheets for sound deadening, in order to permit a larger separation between the posts, and by this means to make a further reduction in the total costs of noise barriers.

Another object of the invention was to provide a sheet which is suitable for use as a sound-deadening unit and which does not impair, or only very slightly impairs, the good aesthetics of a noise barrier composed of transparent acrylic sheet.

Another object of the present invention was to provide sound-deadening sheets which have particularly high weathering resistance and which, where appropriate, can also be designed as self-cleaning systems.

Finally, there is yet another problem specifically relating to sound-deadening sheets composed of plastic. If these sheets are used at road sides, and if a vehicle collides with the sound-deadening unit there is serious risk of formation of dangerous splinters or of ignition of the plastics units. The danger created by splinters or by burning sound-deadening units can be very serious. There is therefore an urgent requirement for sound-deadening sheets composed of plastic with an increased level of safety with respect to splintering and to fire.

The sheet composed of acrylic glass and described in claim 1 achieves these objects, together with other objects which, although not specifically mentioned, are obvious or necessary consequences of the circumstances discussed herein.

Useful modifications of the sound-deadening sheets of the invention are protected by the subclaims dependent on claim 1.

With regard to use of the sheets of the invention, the claim of the appropriate category provides a solution of the object set.

An acrylic sheet whose dimensions size [sic] is 2×2 m or greater and whose thickness is more than 8 mm, preferably more than 12 mm, and which has, embedded into the acrylic sheet to bind splinters in the event of a fracture, threads, tapes, grids or nets composed of a material incompatible with the acrylic sheet, and which has a proportion of non-transparent fillers, based on the total weight of the sheet (reduced by the weight of the embedded materials) in the range from 40 to 80 per cent by weight constitutes a not readily foreseeable method of providing a non-transparent sound-deadening sheet unit which can be used in noise barriers (NBs) and which can be combined in an ideal manner with previously known transparent sound-deadening acrylic sheets, and has very many other advantages, some of which are highly surprising.

In this context, mention should first be made of the outstanding mechanical properties of the inventive acrylic sound-deadening sheet. For example, some of the values found for tensile strength, tensile strain at break, modulus of elasticity (tensile), flexural strength, modulus of elasticity (flexural), and thermal coefficient of expansion found for the non-transparent sheet of the invention are markedly superior to the corresponding values for transparent acrylic sound-deadening material, given the same sheet dimension and thickness.

The high modulus of elasticity of the inventive non-transparent acrylic sound-deadening sheet has proven to be very advantageous. Because the modulus of elasticity is higher when compared with the transparent sound-deadening sheet composed of unfilled acrylic sheet, a greater separation between supports or posts is possible when erecting a noise barrier. The total costs of a noise barrier can therefore be reduced.

In addition, when compared with known transparent NB acrylic sheets, the inventive NB sheets permit a marked reduction in the thickness of the sheets, at the dimensions currently usual, without any resultant need to accept poorer mechanical and acoustic properties. The desired degree of sound deadening is ensured by the high weight per unit area, despite reduced sheet thickness.

The fillers are moreover generally markedly lower-priced than the acrylic sheet matrix material, and the high content of filler therefore also achieves a marked reduction in costs.

The highly filled sheets of the invention also have improved fire performance, and this means that they are flame retardant to ZTV LSW 88, and also achieve fire classification B2, meaning that the level of smoke generation and fire spread is small in the event of a fire. Surprisingly, however, it is also possible to achieve fire classification B1 using the inventive non-transparent sound-deadening sheets (NT sound-deadening sheets) composed of highly filled acrylic sheet as long as suitable fillers are used, e.g. aluminium hydroxide and the like.

Another highly exceptional feature is that, despite the relatively high proportion of fillers, the inventive sheet can achieve the splinter-safety level of transparent acrylic sheets as long as appropriate splinter-binding systems are used. Despite the higher brittleness of the highly filled plastics materials, all of the requirements placed upon systems of this type are satisfactorily met in sheets of the invention comprising embedded splinter-binding systems such as polyamide threads, steel cables, preferably plastics-coated, or similar systems.

Finally, the requirements placed upon the quality of the acrylic sheet matrix material are lower in the case of the inventive non-transparent sheet than in the case of conventional transparent NB sheets composed of acrylic sheet. This provides a surprising opportunity for recycling. The non-transparent sound-deadening sheet itself, production waste arising, cut material, sound-deadening sheets returned after the period of service and other waste from production can be reused as raw material for production after comminution and grinding to a desired particle size, preferably about 50 μm.

For the purposes of the invention, a sound-deadening sheet composed of acrylic sheet is an acrylic sheet in the form of a sheet unit which can be a constituent of a noise barrier.

The term "sheets" is intended to mean sheet-like structures of any desired geometry, and these may be round, have corners, be semicircular, or have any other shape. However, the sheets are preferably square or rectangular. The sheets may have rounded-off or bevelled corners or edges.

The sheets composed of acrylic sheet according to the invention have certain minimum dimensions. The size here is 2×2 m or greater. Dimensions of 3×2 m or 4×2 m are preferred, because the filled acrylic sheets have high mechanical stability. However, greater dimensions can also be produced, as can any of the intermediate dimensions, either directly during the process of producing the sheets or subsequently thereto by downstream operations on finished cast sheets. Insofar as the sheets provided by the invention are not square or rectangular, a "size" of 2×2 m means that the sheet of round or irregular shape encompasses or includes the same amount of two-dimensional area, or that the sheet of round or irregular shape has an area of at least 4 $m^2$.

The relatively large size of inventive sheets is characteristic, as is the thickness of more than 8 mm, preferably more than 12 mm, distinguishing the sound-deadening sheets of the invention clearly from semi-finished products or other relatively small sheets. The thickness is a significant characteristic insofar as the necessary degrees of sound deadening are achievable only through appropriate thicknesses. Typical thicknesses are more than 8 mm, preferably more than 10 mm, particularly preferably more than 12 mm, preferably in the range from 8 to 40 mm, advantageously in the range from 10 to 40 mm, even more advantageously in the range from 12 to 35 mm, and particular preference is given to sheets of thickness from 15 to 30 mm for the NB sector. However, sheets of thickness 40 mm or indeed even thicker can also be manufactured as required by the intended purpose, and for specific applications the measurements may also be greater or smaller.

The plastics sheets of the invention have a highly filled matrix composed of acrylic sheet. By way of example, these sheets may be cast from methyl methacrylate syrup. "Filled" acrylic sheet means acrylic sheet which comprises fillers. "Highly filled" means that the content of fillers, based on the total weight of the sheet composed of acrylic sheet, is in the range from 40 to 80 per cent by weight. The "total weight" of the sheet means for the purposes of the invention the total of the weights of all of the substances involved in the structure of the sheet other than the materials, such as threads, tapes, nets and grids, embedded for splinter-binding. If the filler content is below 40 per cent by weight, the loss of transparency is out of proportion with the improvement in mechanical properties, and also with the cost saving, and if the filler content is above 80 per cent by weight the sheets can easily become brittle and can break apart, meaning that the matrix loses its property of durably binding the filler particles. Sheets whose filler content is in the range from 50 to 60 per cent by weight have a particularly balanced property profile.

The nature and shape of the fillers present in the sound-deadening sheet of the invention may be varied over a wide range as a function of the specific intended application. Fillers which may be used with advantage when producing the sound-deadening sheet of the invention include talc, dolomite, naturally occurring talc-and-dolomite intergrowths, mica, quartz, chlorite, aluminium oxide, aluminium hydroxide, clays, silicon dioxide, silicates, carbonates, phosphates, sulphates, sulphides, oxides, metal oxides, powdered glass, glass beads, ceramic, kaolin, porcelain, cristobalite, feldspar, and/or chalk.

In principle, preference is also given to silanized grades of fillers, because the silanization can give better matrix adhesion, when comparison is made with unsilanized fillers.

Types of filler which generate particular interest are minerals in which mica, chlorite, or quartz is present, examples being ®Plastorit grades from Naintsch, talc-dolomite intergrowths, in particular white talc-pure dolomite intergrowths, BC micrograde from Naintsch, ®DORSILIT powdered crystalline quartz from Dorfner, ®SIL-CELL microcellular additive combinations from Stauss, St. Pölten and ®Apyral grades (aluminium hydroxides) from Nabaltec.

An SE specific extender (talc-dolomite intergrowth) at a concentration in a range from 40 to 80% is particularly advantageous. As mentioned above, sheets with relatively high filler content have lower production costs and better mechanical properties (modulus of elasticity). However, the more highly filled sheets also exhibit less spread of fire and less smoke generation in the event of a fire.

The fire performance of sheets of the invention can be still further improved by using mixtures of SE specific extender and aluminium hydroxide. In the event of a fire, the aluminium hydroxide can have a self-extinguishing effect via elimination of water. The degree of fineness of the aluminium hydroxide is also of particular significance here. Fine aluminium hydroxide is in particular more suitable than coarse grades, because in the event of a fire it liberates not only chemically bonded water but also moisture bound by absorption.

The types of filler mentioned may have various morphologies. They may be spherical or non-spherical, preference being given to fillers in fibre or splinter form, in particular to those with laminar geometries. Advantageous acrylic sheets for the NB sector with particularly good combinations of properties are obtained if the shape of the reinforcing fillers present is that of a platelet or needle. The more laminar the geometry of the fillers, the higher the impact strength of the sheets, and therefore the lower its modulus of elasticity.

One particular embodiment of the sheet resulting according to the invention arises when the filler particles used are lamellar fillers. For the purposes of the invention, these are fillers which can assume a preferred orientation during the casting procedure (production of the sheet in the casting process, cast sheet).

The size of the filler particles can also play a part in determining the quality of the inventive sheets. For example, the stiffness of the sheet can be controlled by using an appropriate size for the fillers. The finer the filler, the higher the modulus of elasticity of the sheet and its impact strength. The grain size range for the fillers used is generally from about 0.01 to about 100 μm. The average particle size of the filler used is advantageously in the range from 0.01 to 80 μm, in particular in the range from 0.05 to 30 μm, very particularly advantageously in the range from 0.1 to 20 μm. The finer the reinforcing fillers used, the higher the stiffness and impact strength of the sheet. If relatively coarse fillers are used, the resultant sheets are relatively brittle. Particularly advantageous acrylic sheets according to the invention are characterized in that the residue from the fillers used during 20 μm screening is less than two per cent by weight. It is very particularly advantageous to use fillers where the residue from the fillers used on 12 μm screening is less than two per cent by weight. By way of example, the inventive sheets are obtainable by polymerizing a (meth) acrylate system in a casting process, preferably by the cell casting process or by one of the modifications thereof, where the polymerizable system comprises:

| | | |
|---|---|---|
| A) | a) (meth)acrylate | 50-100% by wt |
| | a1) methyl (meth)-acrylate | 0-99.99% by wt |
| | a2) $C_2$-$C_4$ (meth)-acrylate | 0-99.99% by wt |
| | a3) $\geqq C_5$ (meth)-acrylate | 0-50% by wt |
| | a4) polyfunctional (meth)acrylates | 0.01-50% by wt |
| | b) comonomers | 0-50% by wt |
| | b1) vinylaromatics | 0-50% by wt |
| | b2) vinyl esters | 0-50% by wt |

where the selection of components a) and b) is such that together they give 100 per cent by weight of the polymerizable component A), B) for each 1 part by weight of A), from 0 to 12 parts by weight of a (pre)polymer which is swellable or soluble in A), C) initiator, its amount being sufficient to cure polymerizable component A), D) where appropriate, means of adjusting the viscosity of the system, E) conventional additives, their amount being up to 3 parts by weight for each 1 part by weight of A), and F) from 0.33 to 4 parts by weight of fillers for each 1 part by weight of binder (entirety of A) to E)), and the viscosity of the polymerizable system prior to the polymerization is greater than 0.1 Pa.s (greater than 100 cP).

For the purposes of the invention, homogeneous distribution of the fillers over the entire sheet is desirable. An example of a way of achieving this distribution is to utilize the viscosity of the (meth)acrylate system which is to be polymerized to give the sheet. The inventive sheet is preferably obtainable by polymerizing a (meth)acrylate system whose viscosity is greater than 0.1 Pa.s (100 cP) prior to the polymerization. The relatively high viscosity of the polymerization system tends to prevent sedimentation of the fillers during the polymerization. The fineness of the fillers can also be used simultaneously to influence sedimentation behaviour. Relatively coarse fillers have a tendency towards sedimentation, the consequence being "dishing" of the sound-deadening sheet. One specific remedy for this, besides the use of fine fillers, is the use of an agent with thixotropic action.

The invention also includes a process for producing a non-transparent acrylic sheet by a) providing a polymerizable, filled (meth)acrylate composition, b) pouring the composition provided into a previously prepared mould in which have been positioned the threads, tapes, grids or nets intended to be embedded, c) polymerizing the composition in the mould at a temperature above room temperature to give a sheet and d) demoulding the sheet, where the process is characterized in that the viscosity of the polymerizable, highly filled (meth) acrylate composition is adjusted to a value greater than 0.1 Pa.s (100 cP) prior to the polymerization.

A first advantageous variant of the process of the invention is characterized in that the viscosity of the polymerizable composition is regulated by varying the ratio by weight of (pre)polymer to polymerizable monomers in the composition.

As an alternative thereto, or in combination therewith, it can also be advantageous to regulate the viscosity of the composition by varying the proportion of viscosity-adjusting agents. These viscosity-adjusting, i.e. regulating, agents are known per se to the person skilled in the art. By way of example, they include ionic, non-ionic and zwitterionic emulsifiers.

Other advantageous means or processes for influencing and/or adjusting the viscosity of the polymerizable composition encompass, inter alia, the following measures:

The viscosity of the polymerization system may be varied by adding a regulator.

It can be advantageous to control the viscosity of the polymerization system by way of the mixing ratio of (pre)polymer (prepolymer) and monomeric, polymerizable constituents of the polymerization system.

The nature and amount of wetting-agent additives used, such as lecithin or else ®Catafor and the like can permit adjustment of the viscosity to the desired value.

The filler concentration per se affects the viscosity of the polymerization system, as does the nature of the filler or of the filler mixture (particle size, oil number, surface treatment).

Conventional additives, e.g. agents with thixotropic action (such as ®Aerosils) may also alter the viscosity of the polymerization system.

The polymerization temperature may also be used to influence the viscosity of the system.

Finally, the initiator concentration and the kinetics of the polymerization reaction can exert an influence on the viscosity of the polymerization system and thus on the degree of sedimentation of the fillers.

Reinforcement (threads, tapes, nets, grids) composed of materials incompatible with the matrix material, preferably plastics incompatible with the acrylic sheet, are introduced into the filled, non-transparent sound-deadening acrylic sheets (NT sound-deadening sheets), the form of the reinforcement being sheet-like (grids, nets) or else filamental (threads, tapes).

In this context, materials incompatible with the acrylic sheet of the matrix is intended to mean that the materials of the matrix and the embedded material do not mix with one another without forming a phase boundary, under the conditions for production and use of the sheet.

Threads, tapes, grids or nets composed of polyamide, polyester and/or polypropylene and embedded into the matrix composed of acrylic sheet are therefore particularly suitable in one embodiment of the invention for binding splinters in the event of fracture of the sound-deadening sheet.

In another particular variant here, inventive acrylic sheets are characterized in that they have threads embedded into the highly filled plastics matrix to bind splinters in the event of fracture.

These plastics sheets may be produced in any manner familiar to the person skilled in the art.

An example of a procedure here is that a cell is formed using two prefabricated cast plastics sheets, e.g. acrylic sheets (2 000 mm×1 220 mm×8 mm), with the aid of a peripheral seal of thickness 4 mm. Monofilament synthetic polymer threads, e.g. polyamide threads, for example with diameter 0.9 mm, are then clamped approximately centrally or else specifically non-centrally into this cell, parallel to one another, each at a separation of about 30 mm. A low-viscosity cold-curing methacrylate resin comprising an external plasticizer based on a citric ester and comprising a redox initiator system is then charged to the cell.

Complete curing of the inner layer and removal of the sheets gives a plastics sheet.

The inventive NT sound-deadening sheets composed of non-transparent, highly filled acrylic sheet may also form a useful retention system. For the purposes of the present invention, the term retention system means a device suitable for preventing an impacting body, such as a vehicle, from penetrating the device. According to one preferred embodiment, an inventive retention system can prevent a body whose impact with the system is perpendicular and whose velocity is at least 5, preferably at least 7, meters per second, and whose energy is at least 5 000 joules, preferably at least 7 000 joules, from penetrating the system, thus being [sic] effectively retained.

To this end, the inventive NT sound-deadening sheet comprises at least one embedded metal cable, there being, at least partially, a layer of plastic between the surface of the metal cable and the transparent acrylic matrix. This is a surprising and not readily foreseeable method of providing a sound-deadening retention system which is particularly inexpensive to maintain and install. A factor to be considered here is that an additional installation step is dispensed with, and, in contrast to conventional retention systems, the noise barrier is practically maintenance-free.

Extraction forces for the steel wire from the acrylic sheet matrix of the highly filled, non-transparent acrylic sheet are generally greater than 50 N, preferably greater than 100 N, but no resultant restriction is intended. This force is determined in a known manner by using forces to load bare metal cable. The minimum force required to extract the cables is defined as the extraction force.

A preferred embodiment of the acrylic sheet of the invention is characterized in that it has steel threads embedded into the highly filled plastics matrix to bind splinters in the event of a fracture and as a retention system, the threads having, where appropriate, a coating of plastic, preferably having a coating of plastic composed of polyamide.

The inventive sheets are poly(meth)acrylate sheets. These have a high, preferably predominant, i.e. relatively high [sic] content of 50 per cent by weight or more of poly(meth) acrylates. Poly(meth)acrylates are polymers assumed to have structural units of the formula (I)

(I)

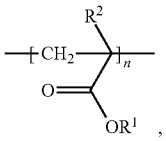

where $R^1$ is an organic radical, preferably $C_{1-6}$-alkyl, with preference $C_{1-4}$-alkyl, $R^2$ is H, $C_{1-6}$-alkyl, with preference H or $C_{1-4}$-alkyl, very particularly preferably H or $CH_3$, and n is a positive whole number greater than 1.

$C_{1-4}$-alkyl encompasses linear and branched alkyl radicals having from one to four carbon atoms. Of particular interest are methyl, ethyl, n-propyl, iso-propyl, n-butyl, 2-methyl-l-propyl, sec-butyl, 2-methyl-2-propyl.

$C_{1-6}$-alkyl encompasses the radicals mentioned under $C_{1-4}$-alkyl and also radicals having 5 or 6 carbon atoms, preferably 1-pentyl, 2-pentyl, 3-pentyl, 2,2-dimethyl-1-propyl, 3-methyl-1-butyl, 3-methyl-2-butyl, 2-methyl-2-butyl, 2-methyl-1-butyl, 1-hexyl.

Examples of compounds which have the abovementioned structural unit include polymethyl acrylate, polyethyl acrylate, polymethyl methacrylate, polypropyl acrylate, polybutyl acrylate, polypropyl methacrylate, polybutyl methacrylate and copolymers which contain two or more of these types of polymer. For the purposes of the invention, the first four compounds are preferred. Polymethyl methacrylate (PMMA) is very particularly preferred.

Besides the chemical mixtures (random copolymers or else block copolymers) produced by copolymerizing at least two substituted or unsubstituted acrylic ester monomers (e.g. methyl methacrylate-n-butyl methacrylate copolymers), it is also possible for the purposes of the invention to use poly (meth)acrylate sheets composed of copolymers which contain up to 50% by weight of at least one other monomer which has vinyl unsaturation and is copolymerizable with at least one substituted or unsubstituted acrylic ester monomer.

Examples of these include methyl methacrylate-styrene copolymers and methyl methacrylate-butyl acrylate-styrene terpolymers.

The comonomers are optional constituents or components, preferably present in a subordinate amount in the acrylic sheet and taking the form of copolymers in which they are present. Their selection is generally such that they do not have any adverse effect on the properties of the poly(meth)acrylate to be used according to the invention.

One of the uses of the comonomer(s) mentioned comprises modifying the properties of the copolymer in a desired manner, e.g. by raising the level of, or improving, the flow properties, if the copolymer is exposed to relatively high temperatures during its processing, or reducing residual colour in the copolymer, or, by way of use of a polyfunctional monomer, so as to introduce a certain or defined degree of crosslinking into the copolymer.

Monomers suitable for this purpose include vinyl esters, vinyl chloride, vinylidene chloride, styrene, α-methylstyrene and the various halogen-substituted styrenes, vinyl and isopropenyl ethers, dienes, e.g. 1,3-butadiene and divinylbenzene. An example of a particularly preferred method of minimizing the colour of the copolymer is the use of an electron-rich monomer, for example a vinyl ether, vinyl acetate, styrene or α-methylstyrene.

Among the comonomer compounds mentioned, particular preference is given to aromatic vinyl monomers, e.g. styrene or α-methylstyrene.

Physical mixtures, known as blends, are also preferred for the poly(meth)acrylate sheets.

The inventive [lacuna] the inventive poly(meth)acrylate sheet may moreover comprise conventional additives. These include antistatic agents, antioxidants, mould-release agents, flame retardants, lubricants, dyes, flow improvers, fillers, light stabilizers and organic phosphorous compounds, such as phosphites or phosphonates, pigments, agents with thixotropic action, UV stabilizers, weathering stabilizers and plasticizers.

Fillers are generally solid additives which differ substantially from the poly(meth)acrylate matrix in their composition and structure. These may be either inorganic or organic materials. They are well known to persons skilled in the art.

Preference is given to use of fillers which are inert under the conditions of depolymerization of the poly(meth)acrylates. For the purposes of the invention, fillers which are inert under the conditions of depolymerization of the poly(meth)acrylates are substances which do not have a substantial adverse effect on the depolymerization of (meth)acrylate polymers, or indeed render the same impossible. This property of the fillers permits simple recycling of the (poly(meth)acrylate [sic] sheets.

Poly(meth)acrylates, especially PMMA, are among the few plastics which have excellent suitability for direct chemical recycling. This means that when these polymers are suitably heated at certain temperatures and pressures they can be broken down completely to regenerate the corresponding monomer units (depolymerization). For example, various continuous and batch procedures are described in the literature and in patent specifications for the depolymerization of polymethyl methacrylate (PMMA) and the reclamation of the resultant monomeric methyl methacrylate (MMA) via thermal treatment of acrylic sheet waste at temperatures >200° C., condensation of the resultant monomer vapour, and work-up of the crude monomers. The process most frequently used industrially charges the polymer material to a tank partially filled with lead, and the tank is heated externally. At temperatures above 400° C. the polymer material depolymerizes, and the resultant monomer vapour passes by way of a pipeline into a condenser where it is condensed to give crude liquid monomer. Similar depolymerization processes are disclosed by way of example in DE-A 21 32 716.

One way of obtaining the inventive sheets is polymerization of a (meth)acrylate system in a casting process, preferably by the cell casting process, Rostero process or other modifications of the cell casting process, where the polymerizable system encompasses the components A) to F) given above.

Component A) is an essential constituent of the (meth) acrylate system to be polymerized.

The use of a constituent enclosed in brackets is optional, and therefore (meth)acrylate represents acrylate and/or methacrylate.

Monomer A) comprises at least 50% by weight of (meth) acrylate, preference being given to monofunctional (meth) acrylates whose ester radical is $C_1$-$C_4$. Longer-chain esters, i.e. those whose ester radical is $C_5$ or longer-chain, are subject to a limitation of 50% by weight in component A). Component A) preferably comprises at least 40 per cent by weight of methyl methacrylate.

The stated amount of the long-chain (meth)acrylates make the system more impact-resistant. Although these esters therefore make the sheet more flexible, they also make it softer, and for amounts above 50% by weight the result would be a restriction on performance characteristics.

Besides the (meth)acrylates, component A) may also comprise other comonomers, their proportion being subject to a restriction of 50% by weight. Among these comonomers, vinylaromatics and/or vinyl esters may be present in component A), in each case at up to 50% by weight. Higher proportions of vinylaromatics are difficult to copolymerize and can lead to demixing of the system. Higher proportions of vinyl esters may moreover cure insufficiently at low temperatures, and tend to increase shrinkage.

Component A) is preferably composed of from 80 to 100% by weight, particularly preferably of from 90 to 100% by weight, of (meth)acrylates, because use of these monomers can give sheets with advantageous processing properties and performance characteristics. The proportion of $C_2$-$C_4$ esters in (meth)acrylates is preferably subject to a restriction of 50% by weight in component A), and the maximum amount of these esters present in component A) is preferably 30% by weight, and particularly advantageously 20% by weight. Sheets of this composition can be particularly flexible.

Particularly suitable monofunctional (meth)acrylates are methyl methacrylate, butyl methacrylate, butyl acrylate, 2-ethylhexyl acrylate, ethyl triglycol methacrylate, hydroxypropyl methacrylate.

Particularly suitable comonomers are vinyltoluene, styrene, vinyl esters.

There is a preferred restriction of a maximum of 20% by weight of styrene in A), because higher content can lead to problems during polymerization.

Polyfunctional (meth)acrylates are also essential in component A). The crosslinking action of the polyfunctional (meth)acrylates during the polymerization contributes, inter alia, to a reduction in the water absorption of the sheet. The amount of polyfunctional (meth)acrylates present in component A) of the (meth)acrylate system is preferably from 0.1 to 30% by weight, particularly advantageously from 0.2 to 5% by weight. The polyfunctional (meth)acrylates serve for linking between linear polymer molecules. This can influence properties such as flexibility, scratch resistance, glass transition temperature, melting point, or the progress of curing.

Polyfunctional (meth)acrylates which may be used with preference include:

(1) difunctional (meth)acrylates

Compounds of the general formula:

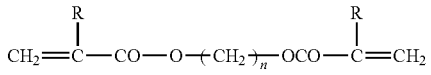

where R is hydrogen or methyl and n is a positive whole number from 3 to 20, e.g. the di(meth)acrylate of propanediol, of butanediol, of hexanediol, of octanediol, of nonanediol, of decanediol, or of eicosanediol, and compounds of the general formula:

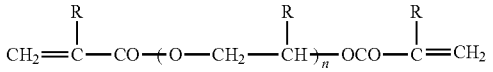

where R is hydrogen or methyl and n is a positive whole number from 1 to 14, e.g. the di(meth)acrylate of ethylene glycol, of diethylene glycol, of triethylene glycol, of tetraethylene glycol, of dodecaethylene glycol, of tetradecaethylene glycol, of propylene glycol, of dipropylene glycol or of tetradecapropylene glycol; and glycerol di(meth)acrylate, 2,2'-bis [p- (y-methacryloxy-p-hydroxypropoxy)phenylpropane] [sic] or bis-GMA, biphenol[sic] A dimethacrylate, neopentyl glycol di(meth)acrylate, 2,2'-di (4-methacryloxypoly-ethoxyphenyl)propane having from 2 to 10 ethoxy groups per molecule and 1,2-bis(3-methacryloxy-2-hydroxypropoxy)butane.

(2) tri- or polyfunctional (meth)acrylates trimethylolpropane tri(meth)acrylates and pentaerythritol tetra(meth)acrylate.

Preferred conventional polyfunctional (meth)acrylates encompass, inter alia, triethylene glycol dimethacrylate (TEDMA), trimethylolpropane trimethacrylate (TRIM), 1,4-butanediol dimethacrylate (1,4-BDMA), ethylene glycol dimethacrylate (EDMA).

Other preferred components of a (meth)acrylate system to be used according to the invention are polyfunctional (at least bifunctional) urethane (meth)acrylates.

Component B) is an optional component, but its use is very preferable.

In principle, two different methods may be used to provide B). Firstly, B) in the form of a polymeric substance may be mixed with A). Secondly, A) may be prepolymerized, giving what is known as a syrup. This syrup itself then comprises monomeric constituents from the group A) and polymeric constituents from the group B) in a mixture with one another.

To adjust the viscosity of the resin and the entire rheology of the system, and to improve curing, a polymer or prepolymer B) may—as stated—be added to component A). This (pre)polymer is to be swellable or soluble in A). From 0 to 12 parts of the prepolymer B) are used for one part of A). Poly (meth)acrylates are particularly suitable, and these may be used in the form of solid polymer dissolved in A) or in the form of what is known as syrups, i.e. partially polymerized mixtures of appropriate monomers. Polyvinyl chloride, polyvinyl acetate, polystyrene, epoxy resins, epoxy (meth)acrylates, unsaturated polyesters, polyurethanes or mixtures of these are also suitable. These polymers bring about specific flexibility properties, for example, or control shrinkage, or act as stabilizer or flow improver.

It is preferable to use from 2 to 11 parts of B) for 1 part of A). It is particularly advantageous to use from 4 to 10 parts of B) for 1 part of A). It is very particularly preferable to take from 6 to 9 parts of a (pre)polymer and to mix these with one part of polymerizable monomers A). The (pre)polymer B) is preferably dissolved in A).

In a preferred embodiment, the ratio by weight of components B) and A) of the binder is in the range from 1:1 to 12:1. Within this range an ideal balance of properties can be achieved.

Particularly advantageous ratios B):A) by weight are in the range from 5:1 to 12:1.

Component B) ((pre)polymer) may be any desired polymer. It is particularly advantageously a prepolymer, but can also be a suspension polymer, emulsion polymer and/or regrind from recycling processes. In the simplest case, a prepolymer of MMA is used with from 8 to 10 mol % monomer conversion.

The (pre)polymer B) may be a copolymer, in which case the hardness and flexibility of the sheets can be influenced via the nature and amount of the comonomer in the (pre)polymer B). Comonomers which may be used, and are involved in the structure of the respective (pre)polymer B), include acrylates and methacrylates other than methyl methacrylate (MMA), vinyl esters, vinyl chloride, vinylidene chloride, styrene, α-methyl-styrene and the various halogen-substituted styrenes, vinyl ethers and isopropenyl ethers, dienes, such as 1,3-butadiene and divinylbenzene.

Examples of preferred comonomers for methyl acrylate are ethyl acrylate, butyl acrylate, 2-ethylhexyl acrylate, ethyl methacrylate, n-butyl methacrylate, isobutyl methacrylate, 2-ethylhexyl methacrylate, propyl acrylate, propyl methacrylate, methacrylic acid, ethyl triglycol methacrylate, hydroxypropyl methacrylate.

Component C) is an essential component, indispensable for the curing (polymerization) of the polymerizable system.

The polymerization may proceed by a free-radical route or an ionic route, preference being given to free-radical polymerization. It may proceed thermally, using radiation, and using initiators, preferably using initiators which form free radicals. The conditions for a particular polymerization depend on the monomers selected and on the initiator system and are well known to persons skilled in the art.

Preferred initiators include the azo initiators well known to persons skilled in the art, for example AIBN or 1,1-azobiscyclohexanecarbonitrile, and also peroxy compounds, such as methyl ethyl ketone peroxide, acetylacetone peroxide, ketone peroxide, methyl isobutyl ketone peroxide, cyclohexanone peroxide, dibenzoyl peroxide, tert-butyl peroxybenzoate, tert-butyl peroxy(isopropyl carbonate), 2,5-bis(2-ethyl-hexanoylperoxy)-2,5-dimethylhexane, tert-butyl 2-ethyl-peroxyhexanoate, tert-butyl 3,5,5-trimethylperoxy-hexanoate, 1,1-bis(tert-butylperoxy)cyclohexane, 1,1-bis(tert-butylperoxy)-3,3,5-trimethylcyclohexane, cumyl hydroperoxide, tert-butyl hydroperoxide, dicumyl peroxide, bis(4-tert-butylcyclohexyl) peroxy-dicarbonate, mixtures of two or more of the abovementioned compounds with one another, and mixtures of the abovementioned compounds with compounds not mentioned which can likewise form free radicals.

Use may also be made of redox systems, and use may also be made here of known phlegmatized systems in organic solvents or in aqueous solutions or in aqueous suspension. A system of this type is obtainable from Akzo with the trade mark ®Cadox.

Mixtures of two or more initiators with stepped half-lifetime are also possible. This method can give better control of the polymerization reaction and can eliminate local irregularities, and a more uniform result is obtained. This method can also shorten the post-polymerization time (heat-conditioning of the sheet in heated cabinets).

The amount of component C) can vary within wide limits. It depends on the composition of the monomers, on the nature and amount of the (pre)polymer, and also on the desired polymerization temperature and on the desired molecular weight of the polymer to be prepared. The resultant guideline values, for example for molar masses of from 100 000 to 1 000 000 g/mol (weight-average molar mass) are from $1\times10^{-5}$ to about $1\times10^{-6}$ mol of initiator per mole of polymerizable constituents of the monomer system. The molar mass of the polymer is preferably from 650 000 to 800 000 g/mol.

Component D) is an optional constituent of the polymerizable (meth)acrylate system, but is preferably present in the system. Examples are emulsifiers. Lecithins are preferred. The amount of the substances to be used may vary widely. Preference is given to from 0.01 to 1 part by weight of D) for 1 part by weight of A). From 0.1 to 0.2 part by weight of D) for 1 part by weight of A) is particularly advantageous.

Component E) is optional. These are the usual additives known per se, and examples of these additives have been listed above. E) includes especially those fillers not represented by F). Those included here are therefore fillers with no reinforcing action, e.g. colour pigments and the like, these particularly preferably having a particle size smaller than that of the fillers of component F). The average particle size of the fillers used in accordance with E) is preferably in the range smaller than 10 μm, advantageously in the range smaller than 5 μm, particularly preferably smaller than 1 μm and very particularly preferably smaller than 0.01 μm. The ratio of the average particle sizes of the fillers E) to those of F) is advantageously in the range from 1:3 to 1:1 000, preferably in the range from 1:5 to 1:100 and particularly preferably in the range from 1:10 to 1:50.

Component F) is essential. Other details of this component have been described above.

EXAMPLES

1. Production of a Sheet by Way of Example (Example 1) by the Convection-Oven Process 1.1. Mould Construction Two sheets of Sekurit glass are used as mould. A PVC sealing bead is placed between the glass sheets of the mould. Monofilament polyamide threads of diameter 2 mm are then clamped into the resultant cell, the distance between each being 30 mm. Clamps are then used to secure three sides of the glass sheets. The width of the cell can be varied by using a variety of thicknesses of the sealing bead. In the example, the clearance providing the thickness of the cell was about 15 mm. The fourth side is sealed after filling.

The resultant sealed sheet system is placed horizontally and inserted into a convection oven.

1.2. Poly(meth)acrylate System for Filling the Mould

| No. | Parts by weight | Substance | Group | % by weight or parts (pt.) |
|---|---|---|---|---|
| 1) | 49.2390 | Prepolymer[1]* is about 44.32 pt. of A) and 4.92 pt. of B) | A)<br>B) | 99.989% of A)<br>0.1 pt. of B) for 1 part of A) |
| 2) | 0.005 | Methacrylic acid | A) | 0.0001% of A) |
| 3) | 0.055 | Crosslinking agent[2]* | A) | 0.001% of A) |
| 4) | 0.001 | AVN[3]* | C) | |
| 5) | 0.6 | SER AD FA 192[4]* | D) | |
| 6) | 0.1 | ® Tinuvin P[5]* | E) | |
| 7) | 50.00 | SE-Super[6]* | F) | 1 pt. of F) for 1 pt. of ΣA)-E) |

[1]*Prepolymer is an MMA-based syrup, in which methyl methacrylate has been prepolymerized in a known manner to a conversion of about 10% (90% by weight of residual monomer). The viscosity of the prepolymer was about 450 cp.

[2]*Crosslinking agent is triethylene glycol dimethacrylate (TEDMA).

[3]*AVN is the free-radical generator azovalero-nitrile.

[4]*SER AD FA 192 indicates a phosphoric ester from the ethoxylated nonylphenol phosphate group.

[5]*® Tinuvin P is a light stabilizer from Ciba Spezialitatenchemie GmbH and is a 2-(2-hydroxy-phenyl) benzotriazole.

[6]*SE-Super from Naintsch, A-8045 Graz-Andritz, Austria. This is an intergrowth of white talc with pure dolomite, its composition from chemical analysis being 17% of $SiO_2$, 22% of MgO, 24% of CaO, and its loss on ashing for 1 h at 1050° C. being 37%. Dolomite content (Leco) is 75%. Screen analysis to DIN 66165 to 12 μm gives 2.0% residue.

1.3. Preparation of Mixture

The fillers and additives required are dispersed in about a third of the prepolymer (syrup) required. For this, a dispersing agent is first metered in and is followed by the additives required, e.g. UV stabilizer, crosslinking agent, heat stabilizers, etc., and also the filler.

This solution is dispersed for at least 30 min in a mixer which can be cooled and evacuated. The dispersion temperature during this process should not exceed 50° C. After dispersion, the mixture is cooled to room temperature, and diluted with the remaining amount of syrup, and the required catalyst is then added in the form of a solution.

This solution is then stirred in vacuo for a further 30 min.

1.4. Filling and Polymerization in the Cell, and Removal

The mixture described is poured into the mould;

charging takes place directly from the mixture tank by way of a 25 μm bag filter into the mould.

The sheets are polymerized in the convection process. About 90% conversion is achieved during the main polymerization. The sheets are post-polymerized in a heat-conditioning oven at 120° C. After the sheets have cooled, the upper glass sheet is removed from the cell and the poly(meth)acrylate sheet is removed.

2 to 4

Further sheets were manufactured in accordance with Example 1. In particular, the formulation of the poly(meth) acrylate system was varied in Examples 2 to 4. The systems used had the following composition:

Composition of (meth)acrylate systems 2 to 4 for [lacuna], each in parts by weight:

| Substance | Ex. 2 | Ex. 3 | Ex. 4 |
|---|---|---|---|
| Prepolymer | 34.1185 | 32.115 | 28.115 |
| Methyl methacrylate | 5 | 7 | 6 |
| MAA | 0.005 | 0.005 | 0.005 |
| Crosslinking agent (TEDMA) | 0.055 | 0.06 | 0.06 |
| AVN | 0.0015 | 0.02 | 0.02 |
| SER AD FA 192 | 0.72 | 0.70 | 0.70 |
| ® Tinuvin P | 0.10 | 0.10 | 0.10 |
| Plastorit Super[6]* | 60 | 30 | 25 |
| Martinal ON 310[7]* | — | 30 | 45 |

[7]*Martinal ON 310 is an aluminium hydroxide grade from Martinswerke [sic] GmbH. Its average particle size is from 9 to 13 μm. Oil absorption is from 24 to 28 $cm^3$/100 g. Moisture content is <0.3%

Various tests were carried out on the NT SD sheets of the invention, their thickness being 15 mm and their dimensions being 2×2 m. Some particular physical properties were calculated and compared with the calculated properties of transparent sheets of identical dimensions.

The results showed that the sheets according to the invention complied with all of the relevant standards. The inventive sheets have markedly better mechanical properties than transparent sound-deadening material with embedded nylon threads, which may be termed SD CC material. An arrangement with clamping on three sides using a distance of 5×2 m between posts could be implemented using NT SD at a thickness of 35 mm. This is impossible with LS CC material of thickness 35 mm, because deflection and stress values under load exceed the tolerances. With clamping on four sides, a distance of 5×2 m between posts can be implemented using the inventive NT SD material even when the thickness is only 12 mm.

The inventive sheet in accordance with Example No. 4 was subjected to a flame retardency test to DIN 4102 B1. These test requirements for flame retardency to DIN 4102-B1 were complied with completely. This means that the inventive highly filled NT SD sheets have low flammability.

An inventive sheet in accordance with Example 4 was also subjected to a fracture test. For this, the abovementioned sound-deadening unit was placed upon four wooden stands (height about 860 mm), and was not clamped or secured. A wooden pallet of size 1 200×1 200×140 (L×W×H) was placed on the floor to protect the same.

A cylindrical metal weight weighing 400 kg was allowed to fall from a height of 1 500 mm above the sound-deadening unit onto the centre of the unit. The kinetic energy of the weight on impact was 5.89 J, the velocity being 5.42 m/s (19.5 km/h). The metal weight had been provided with a radius at the point of impact. On impact of the metal weight, the acrylic sheet splintered in the typical way. However, no free splinters were produced, but instead all of the acrylic sheet fragments were retained by the embedded threads. This result is regarded as highly surprising for a highly filled system.

The invention claimed is:

1. Acrylic sheet for use as non-transparent sound-deadening unit in noise barriers comprising, a non-transparent sheet wherein the dimension of the sheet is 2 ×2 m or greater at a thickness of more than 8 mm, wherein the sheet contains threads, tapes, grids, or nets made from a material incompatible with the acrylic sheet that have been embedded into the acrylic sheet to bind splinters in the event of fracture of the sheet, and further comprising a filler wherein the proportion of the filler based on the total weight of the sheet reduced by the weight of the embedded threads, tapes, grids or nets, is from 40 to 80 per cent by weight.

2. Acrylic sheet according to claim 1, wherein the thickness of the acrylic sheet is in the range from more than 8 mm to 40 mm.

3. Acrylic sheet according to claim 2, wherein the thickness of the acrylic sheet is in the range from greater than 10 to 35 mm.

4. Acrylic sheet according to claim 1, wherein the thickness of the acrylic sheet is in the range from 12 to 35 mm.

5. Acrylic sheet according to claim 1, wherein the proportion of fillers, based on the total weight of the sheet, is in the range from 50 to 60 per cent by weight.

6. Acrylic sheet according to claim 1, wherein the acrylic sheet has a substantially homogeneous distribution of the fillers in the sheet.

7. Acrylic sheet according to claim 1, wherein the filler is selected from the group consisting of talc, dolomite, naturally occurring talc-and-dolomite intergrowths, mica, quartz, chlorite, aluminium oxide, aluminium hydroxide, clays, silicon dioxide, silicates, carbonates, phosphates, sulphates, sulphides, metal oxides, powdered glass, glass beads, ceramic, kaolin, porcelain, cristobalite, feldspar, chalk and mixtures thereof.

8. Acrylic sheet according to claim 1, wherein the filler particles used are lamellar fillers.

9. Acrylic sheet according to claim 1, wherein the average particle size of the filler used is in the range from 0.01 to 80 μm.

10. Acrylic sheet according to claim 9, wherein the average particle size of the filler used is in the range from 0.05 to 30 μum.

11. Acrylic sheet according to claim 9, wherein the average particle size of the filler used is in the range from 0.1 to 20 μum.

12. Acrylic sheet according to claim 1, wherein the filler is a talc-and-dolomite intergrowth, optionally in a mixture with aluminium hydroxide.

13. Acrylic sheet according to claim 1, obtainable by polymerizing a (meth)acrylate system in a casting process, where the polymerizable system comprises:

| | | |
|---|---|---|
| A) | a) (meth)acrylate | 50-100% by wt |
| | a1) methyl (meth)acrylate | 0-99.99% by wt |
| | a2) $C_2$-$C_4$ (meth)acrylate | 0-99.99% by wt |
| | a3) $\geqq C_5$ (meth)acrylate | 0-50% by wt |
| | a4) polyfunctional (meth)acrylates | 0.01-50% by wt |
| | b) comonomers | 0-50% by wt |
| | b1) vinylaromatics | 0-50% by wt |
| | b2) vinyl esters | 0-50% by wt |

where the selection of components a) and b) is such that together they give 100 per cent by weight of the polymerizable component A), B) for each 1 part by weight of A), from 0 to 12 parts by weight of a (pre)polymer which is swellable or soluble in A), C) initiator, its amount being sufficient to cure component A), D) an optional component for adjusting the viscosity of the system, E) optionally, conventional additives, their amount being up to 3 parts by weight for each 1 part by weight of A), and F) from 0.33 to 4 parts by weight of fillers for each 1 part by weight of binder (entirety of A) to E)), and the viscosity of the (meth)acrylate system prior to the polymerization is greater than 0.1 Pa·s (greater than 100 cP).

14. Acrylic sheet according to claim 13, wherein the casting process is the cell casting process or a modified form thereof.

15. Acrylic sheet according to claim 1, wherein the acrylic sheet has steel threads which have been embedded therein, and which, optionally, have a coating of plastic, wherein the steel threads bind splinters in the event of fracture.

16. Acrylic sheet according to claim 15, wherein the coating of plastic is present and comprises polyamide.

17. Process for producing an acrylic sheet according to claim 1, comprising a) providing a polymerizable, filled (meth)acrylate composition, b) pouring the composition provided into a previously prepared mould in which have been positioned the threads, tapes, grids or nets intended to be embedded, c) polymerizing the composition in the mould at a temperature above room temperature to give a sheet and d) demoulding the sheet, wherein the viscosity of the polymerizable, highly filled (meth)acrylate composition is adjusted to a value greater than 0.1 Pa·s prior to the polymerization.

18. Process according to claim 17, wherein the viscosity of the composition is regulated by varying the ratio by weight of (pre)polymer to polymerizable monomers in the composition.

19. Process according to claim 18, wherein the viscosity of the composition is regulated by varying the proportion of viscosity adjusters.

20. A non-transparent sound-deadening unit comprising noise barrier which comprises an acrylic sheet as claimed in claim 1.

21. Acrylic sheet according to claim 1, wherein the dimension of the sheet is 2×2 m or greater at a thickness of more than 12 mm.

* * * * *